US010723429B1

(12) United States Patent
Wiatrowski et al.

(10) Patent No.: US 10,723,429 B1
(45) Date of Patent: Jul. 28, 2020

(54) POWER STEERING SYSTEM FOR MARINE OUTBOARD MOTOR

(71) Applicant: BRP US INC., Sturtevant, WI (US)

(72) Inventors: Darrell Wiatrowski, Libertyville, IL (US); Benjamin Jones, Saint Francis, WI (US); Mark J. Skrzypchak, Pleasant Prairie, WI (US); Kenneth Chung, Lindenhurst, IL (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 16/262,555

(22) Filed: Jan. 30, 2019

Related U.S. Application Data

(60) Provisional application No. 62/623,814, filed on Jan. 30, 2018.

(51) Int. Cl.
*B63H 20/12* (2006.01)
*B63H 25/18* (2006.01)

(52) U.S. Cl.
CPC ..... *B63H 20/12* (2013.01); *B63H 25/18* (2013.01)

(58) Field of Classification Search
CPC ..... B63H 20/12; B63H 25/18
USPC ..... 440/53, 61 S, 61 R
See application file for complete search history.

(56) References Cited

U.S. PATENT DOCUMENTS

| | | | | |
|---|---|---|---|---|
| 4,496,326 | A | 1/1985 | Boda | |
| 4,993,976 | A * | 2/1991 | Kabuto | B63H 21/265 114/144 R |
| 5,447,456 | A | 9/1995 | Nakayasu | |
| 6,199,498 | B1 | 3/2001 | Hundertmark et al. | |
| 6,524,147 | B1 | 2/2003 | Hundertmark | |
| 6,598,553 | B1 | 7/2003 | Hundertmark | |
| 6,715,438 | B1 | 4/2004 | Hundertmark | |
| 6,892,662 | B2 * | 5/2005 | Watanabe | B63H 20/12 114/144 R |
| 6,902,450 | B2 | 6/2005 | Ohtsuki et al. | |
| 7,325,507 | B1 | 2/2008 | Hundertmark | |
| 8,007,330 | B2 | 8/2011 | Wong et al. | |
| 2005/0199169 | A1 * | 9/2005 | Mizutani | B63H 21/265 114/144 RE |

* cited by examiner

*Primary Examiner* — Anthony D Wiest
(74) *Attorney, Agent, or Firm* — BCF LLP

(57) ABSTRACT

A tiller system has a tiller adapted for steering at least one of a bracket assembly and a motor assembly of a marine outboard motor having a power steering system, a throttle control mounted to the tiller, an electronic torque sensor, and a tiller system control module (TSCM) in electronic communication with the electronic torque sensor. The electronic torque sensor senses torque applied to the tiller and outputs an electronic steering signal as a function of the torque. The TSCM receives the electronic steering signal and controls an operation of the power steering system in response to the electronic steering signal. A method for steering a marine outboard motor, and a marine outboard motor having a tiller system are also described.

19 Claims, 10 Drawing Sheets

POWER STEERING SYSTEM FOR MARINE OUTBOARD MOTOR

CROSS-REFERENCE

The present application claims priority to U.S. Provisional Patent Application No. 62/623,814 filed Jan. 30, 2018, entitled "POWER STEERING SYSTEM FOR MARINE OUTBOARD MOTOR", which application is incorporated herein by reference in its entirety.

TECHNICAL FIELD

The present technology relates to power steering systems for marine outboard motors.

BACKGROUND

Some marine outboard motor power steering systems are known, for example as described in U.S. Pat. No. 6,715,438, issued on Apr. 6, 2004, entitled "Tiller Operated Power Assist Marine Steering System". Such systems are suitable for their intended purposes, but are relatively bulky and require relatively large amounts of hydraulic hose. Other marine outboard motor power steering systems exist that require fewer hydraulic hoses, but have other shortcomings such as lower steering precision.

SUMMARY

It is an object of the present technology to ameliorate at least some of the inconveniences present in the prior art.

According to one aspect of the present technology, there is provided a tiller system for a marine outboard motor, the marine outboard motor having a bracket assembly for mounting the marine outboard motor to a watercraft, a motor assembly pivotably mounted to the bracket assembly about a steering axis, and a power steering system for pivoting the motor assembly about the steering axis, the tiller system comprising: a tiller adapted for steering at least one of the bracket assembly and the motor assembly; a throttle control mounted to the tiller; an electronic torque sensor operatively connected to the tiller to output an electronic steering signal as a function of torque applied to the tiller for steering the motor assembly about the steering axis when the tiller system is in use; and a tiller system control module (TSCM) in electronic communication with the electronic torque sensor to receive the electronic steering signal, the TSCM being adapted for controlling an operation of the power steering system in response to the electronic steering signal.

In some implementations, the tiller includes a tiller bracket adapted for connecting the tiller to the bracket assembly of the marine outboard motor, and the electronic torque sensor is mounted to the tiller bracket.

In some implementations, the electronic torque sensor includes at least one of a strain gauge, a force sensitive resistor, and a proximity sensor.

In some implementations, the electronic torque sensor includes the strain gauge.

In some implementations, the electronic torque sensor includes two strain gauges.

In some implementations, the electronic steering signal is a voltage.

In some implementations, the voltage is at a baseline voltage when no torque is applied to the tiller.

In some implementations: a) the voltage increases from the baseline voltage by: i) a first value when a first magnitude of torque is applied to the tiller in a first direction, and ii) a second value when a second magnitude of torque is applied to the tiller in the first direction, the second value being larger than the first value, and the second magnitude being larger than the first magnitude; and b) the voltage decreases from the baseline voltage by: i) a third value when the first magnitude of torque is applied to the tiller in a second direction that is opposite the first direction, and ii) a fourth value when the second magnitude of torque is applied to the tiller in the second direction, the fourth value being larger than the third value.

In some implementations, the third value is equal to the first value, and the fourth value is equal to the second value.

In some implementations, when the tiller system is in use: a) the TSCM is configured to control the power steering system to steer the motor assembly about the steering axis in the first direction when the voltage is above the baseline voltage; and b) the TSCM is configured to control the power steering system to steer the motor assembly about the steering axis in the second direction when the voltage is below the baseline voltage.

In some implementations, the electronic steering signal is representative of a magnitude and a direction of the torque applied to the tiller.

In some implementations, the electronic steering signal is a first electronic steering signal when a first torque is applied to the tiller, the first torque having a first magnitude and a first direction; and the electronic steering signal is a second electronic steering signal when a second torque is applied to the tiller, the second torque having a second magnitude greater than the first magnitude and a second direction equal to the first direction.

In some implementations, the electronic steering signal is a analog signal that is representative of a magnitude and a direction of the torque applied to the tiller.

In some implementations, when the tiller system is in use: a) the TSCM is configured to control the power steering system to steer the motor assembly about the steering axis in a clockwise direction when the analog signal represents a torque applied to the tiller in a clockwise direction about the steering axis; and b) the TSCM is configured to control the power steering system to steer the motor assembly about the steering axis in a counter-clockwise direction when the analog signal represents a torque applied to the tiller in a counter-clockwise direction about the steering axis.

In some implementations, when the tiller system is in use: a) the TSCM is configured to increase a power steering boost of the power steering system in the clockwise direction when the analog signal represents an increase of a magnitude of the torque applied to the tiller in the clockwise direction about the steering axis; and b) the TSCM is configured to increase the power steering boost of the power steering system in the counter-clockwise direction when the analog signal represents an increase of a magnitude of the torque applied to the tiller in the counter-clockwise direction about the steering axis.

In some implementations, when a magnitude of the torque applied to the tiller is within a predefined range of magnitudes, the TSCM is configured for not causing the power steering system to steer the motor assembly.

In some implementations, the TSCM is configured to: a) receive a motor speed signal representative of an operating speed of the motor assembly, and b) generate a control signal as a function of the electronic steering signal and the motor speed signal for controlling the operation of the power steering system to steer the motor assembly about the steering axis.

In some implementations, the TSCM is operable in a plurality of different operating modes selectable by the operator, a first of the plurality of different operating modes corresponding to a low-boost mode of controlling the power steering system, and a second of the plurality of different operating modes corresponding to a high-boost mode of controlling the power steering system.

According to another aspect of the present technology, there is provided a marine outboard motor, comprising: a bracket assembly for mounting the marine outboard motor to a watercraft; a motor assembly pivotably mounted to the bracket assembly about a steering axis; a power steering system for pivoting the motor assembly about the steering axis; a tiller for steering at least one of the bracket assembly and the motor assembly; a throttle control mounted to the tiller, the throttle control being operatively connected to the motor assembly for controlling the motor assembly; an electronic torque sensor operatively connected to the tiller to output an electronic steering signal as a function of torque applied to the tiller for steering the motor assembly about the steering axis when the marine outboard motor is in use; and a tiller system control module (TSCM) in electronic communication with the electronic torque sensor to receive the electronic steering signal, the TSCM controlling an operation of the power steering system to steer the motor assembly about the steering axis in response to the electronic steering signal.

In some implementations, the tiller includes a tiller bracket connecting the tiller to the bracket assembly and the electronic torque sensor is mounted to the tiller bracket.

In some implementations: a) the bracket assembly is operable to pivot the motor assembly about a trim axis, and b) the tiller bracket extends over the trim axis when the motor assembly is fully trimmed down.

In some implementations, the electronic torque sensor is mounted to the tiller.

In some implementations, the electronic torque sensor includes at least one of a strain gauge, a force sensitive resistor, and a proximity sensor.

In some implementations, the electronic torque sensor includes the strain gauge.

In some implementations, the electronic torque sensor includes two strain gauges.

In some implementations, the electronic steering signal is a voltage.

In some implementations, the voltage is at a baseline voltage when no torque is applied to the tiller.

In some implementations, when the tiller system is in use: a) the TSCM controls the power steering system to steer the motor assembly about the steering axis in a first direction when the voltage is above the baseline voltage; and b) the TSCM controls the power steering system to steer the motor assembly about the steering axis in a second direction that is opposite the first direction when the voltage is below the baseline voltage.

In some implementations, the electronic steering signal is representative of a magnitude and a direction of the torque applied to the tiller.

In some implementations: the electronic steering signal is a first electronic steering signal when a first torque is applied to the tiller, the first torque having a first magnitude and a first direction; and the electronic steering signal is a second electronic steering signal when a second torque is applied to the tiller, the second torque having a second magnitude greater than the first magnitude and a second direction equal to the first direction.

In some implementations, when the magnitude of the torque is within a predefined range of magnitudes, the TSCM does not cause the power steering system to steer the motor assembly.

In some implementations: a) when the magnitude of the torque has a first value, the TSCM controls the power steering system to output a first magnitude of power steering boost; and b) when the magnitude of the torque has a second value that is larger than the first value, the TSCM controls the power steering system to output a second magnitude of power steering boost that is larger than the first magnitude of power steering boost.

In some implementations, the TSCM is configured to: a) receive a motor speed signal representative of an operating speed of the motor assembly, and b) generate a control signal as a function of the electronic steering signal and the motor speed signal for controlling the operation of the power steering system to steer the motor assembly about the steering axis.

In some implementations, the TSCM is operable in a plurality of different operating modes selectable by the operator, a first of the plurality of different operating modes corresponding to a low-boost mode of controlling the power steering system, and a second of the plurality of different operating modes corresponding to a high-boost mode of controlling the power steering system.

In some implementations: a) the power steering system includes an electric motor operable to steer the motor assembly about the steering axis; and b) the TSCM controls an operation of the electric motor to steer the motor assembly about the steering axis in response to the electronic steering signal.

In some implementations: a) the power steering system includes a hydraulic pump operable to steer the motor assembly about the steering axis; and b) the TSCM controls an operation of the hydraulic pump to steer the motor assembly about the steering axis in response to the electronic steering signal.

In some implementations, the tiller is connected to the motor assembly to pivot with the motor assembly about the steering axis.

According to yet another aspect of the present technology, there is provided a method for steering a marine outboard motor having a power steering system, the method comprising: sensing a torque applied to a tiller of the marine outboard motor with an electronic torque sensor; generating an electronic steering signal as a function of the sensed torque; generating a control signal as a function of the electronic steering signal; communicating the control signal to the power steering system of the marine outboard motor; and actuating the power steering system in response to the control signal being received.

In some implementations, sensing of the torque includes sensing a magnitude and a direction of the torque; generating of the electronic steering signal includes generating the electronic control signal as a function of the magnitude and the direction of the torque; and actuating of the power steering system includes actuating the power steering system in response to the magnitude and the direction of the torque.

In some implementations, generating of the electronic steering signal includes generating a voltage representative of the magnitude and the direction of the torque.

For the purposes of this document, the term "fluid conduit" refers to a fluid connection that is defined by at least one physical fluid line or hose and/or other components (such as a hydraulic fluid hose, a fluid pump, a valve, a manifold and the like) that define the fluid conduit. For example, in some implementations, a "fluid conduit" that connects points A and B could be defined by a single fluid hose fluidly connecting the points A and B. As another example, in some implementations, the "fluid conduit" could be defined by two fluid hoses interconnected in series or parallel and fluidly connecting the points A and B. In other examples, the "fluid conduit" could also be defined by more than two fluid hoses and/or fluid pump(s) and/or fluid valves interconnected in series, parallel, or a combination of series and parallel, and fluidly connecting the points A and B.

For the purposes of this document, the term "electronic connection" refers to an electronic connection, which could be either a wired or a wireless connection or a combination of wired and wireless connections, which is defined by one or more electronic components, such as electronic wires, wireless transmitters, electronic connectors and other suitable electronic devices interconnected to carry out the function(s) described with respect to the "electronic connection".

For the purposes of this document, the term "power steering boost", when used in relation to a power steering system of a marine outboard motor, refers to a power output of the power steering system, the power output corresponding to an amount of assistance that the power steering system provides to an operator of the marine outboard motor in steering the marine outboard motor.

For purposes of this application, terms related to spatial orientation such as forward, rearward, upward, downward, left, and right, should be understood in a frame of reference where the propeller position corresponds to a rear of the marine outboard motor. Terms related to spatial orientation when describing or referring to components or sub-assemblies of the marine outboard motor separately from the marine outboard motor should be understood as they would be understood when these components or sub-assemblies are mounted to the marine outboard motor, unless specified otherwise in this application.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1A:
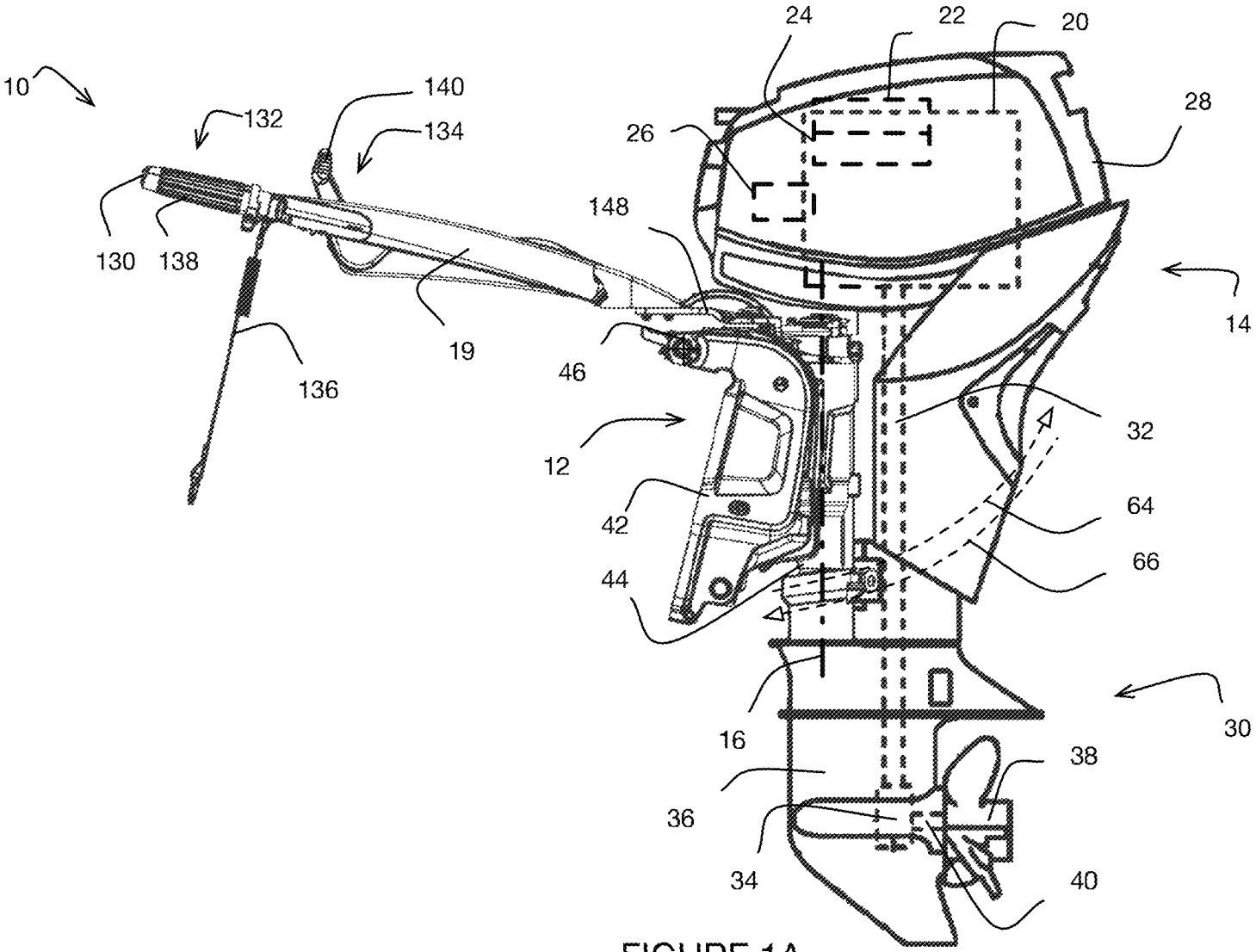
FIG. 1A is a left side elevation view of a marine outboard motor.

With reference to FIG. 1A, a marine outboard motor 10 includes a bracket assembly 12 for mounting the marine outboard motor 10 to a watercraft, a motor assembly 14 pivotably mounted to the bracket assembly 12 about a steering axis 16, and a power steering system 18 (FIG. 6), operated via a tiller 19, for pivoting the motor assembly 14 about the steering axis 16. The motor assembly 14 is shown in an upright position.

As shown schematically in FIG. 1A, the motor assembly 14 includes a motor 20 and a magneto 22 driven by the motor 20. The marine outboard motor 10 further includes a combination of electric and manual starters 24, and a engine management module (EMM) 26. It is contemplated that only a manual starter, or only an electric starter, could be used to start the motor 20.

Figure 1B:
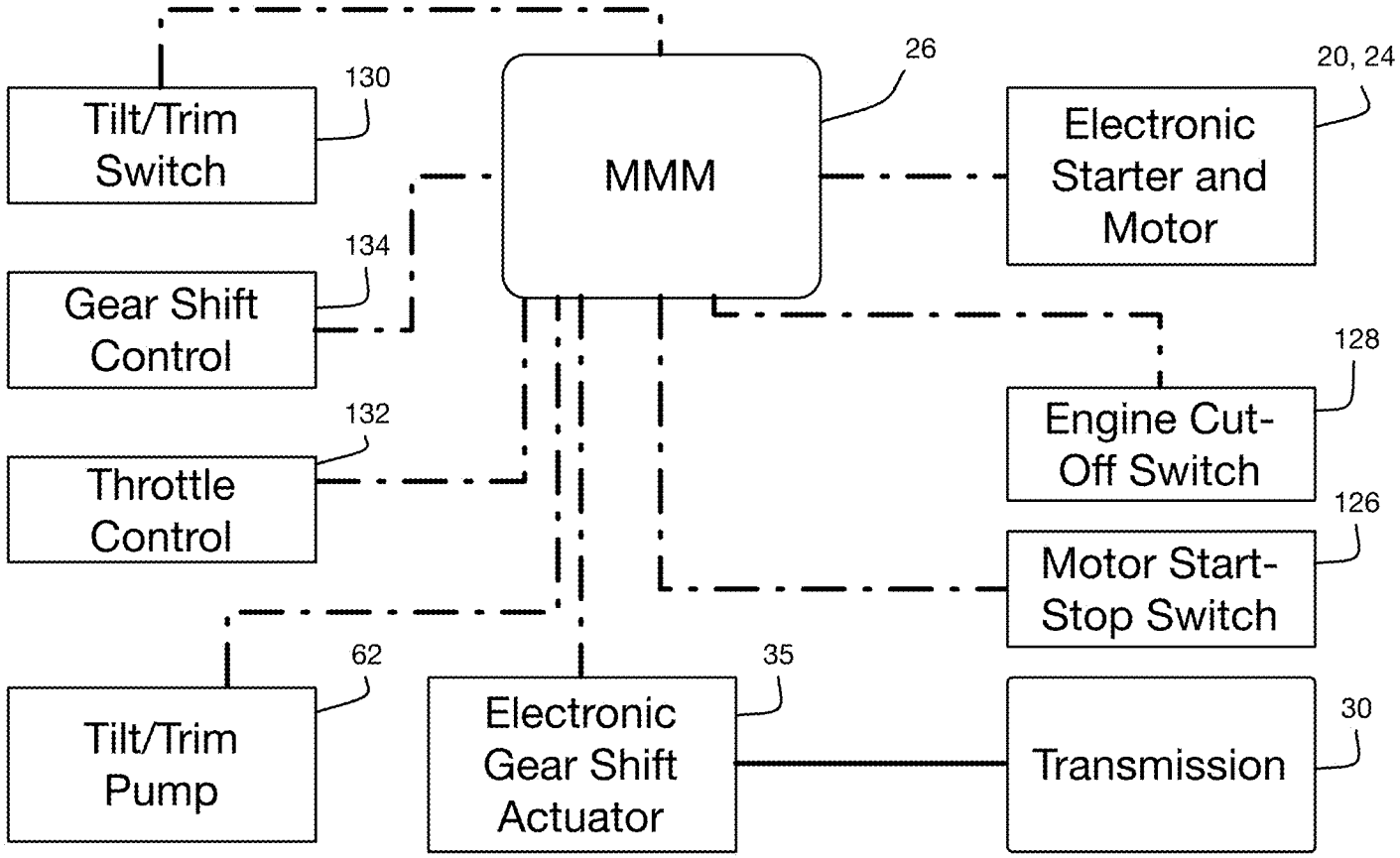
FIG. 1B is a schematic showing electronic connections between an engine management module and various components of the marine outboard motor of FIG. 1A.

As shown schematically in FIG. 1B, the EMM 26 is electronically connected to the motor 20 and controls operation of the motor 20. The magneto 22 generates a power supply (in the present implementation, 20 amperes at 55 volts) that powers the EMM 26 and charges a battery (not shown) that is used to run the electric starter 24 to start the motor 20, as well as various accessories and other functions. A power management module within the EMM 26 transforms this power supply into different voltages that are then distributed to and power the electronic components of the marine outboard motor 10. It is contemplated that the marine outboard motor 10 could have any other suitable electronic system.

Referring back to FIG. 1A, the motor 20 and the EMM 26 are surrounded and protected by a cowling 28. In the present implementation, the motor 20 is a two-stroke gasoline powered internal combustion motor 20. It is contemplated that the motor 20 could be any type of motor, including a four-stroke internal combustion motor and/or an electric motor. It is contemplated that the EMM 26 could be a different type of controller, depending on each particular type of motor 20 for example. For example, where the motor 20 is an electric motor, an electric motor management module could be used to control operation of the electric motor and other elements associated with the marine outboard motor 10.

The marine outboard motor 10 further includes a propulsion unit 30. The propulsion unit 30 is connected at a bottom of the motor assembly 14. The propulsion unit 30 includes a driveshaft 32 and a transmission 34. The driveshaft 32 is operatively connected at its upper end to the motor 20 to be driven by the motor 20. The driveshaft 32 extends downward from the motor 20 to the transmission 34 housed in a gearcase 36 of the propulsion unit 30. The transmission 34 is connected to the bottom end of the driveshaft 32.

The propulsion unit 30 further includes a propeller 38 supported on a propeller shaft 40. The propeller shaft 40 is rotationally supported at a bottom, rear end of the gearcase 36, such that the propeller 38 extends rearward from the propulsion unit 30 for propelling the marine outboard motor 10. The transmission 34 operatively connects the bottom end of the driveshaft 32 to the propeller shaft 40 to selectively drive the propeller 38 to propel the marine outboard motor 10.

The transmission 34 has a forward gear for propelling the marine outboard motor 10 forward, a neutral gear in which the transmission 34 decouples the propeller shaft 40 from the driveshaft 32, and a reverse gear for propelling the marine outboard motor 10 rearward. The gears of the transmission 34 are shifted by an electronic gear shift actuator 35 that is operated via the EMM 26, as shown schematically in FIG. 1B. It is contemplated that a different type of transmission 34 could be used, including a mechanically actuated transmission 34, a transmission 34 that has a single forward gear and no other gears, or a transmission 34 that includes forward and neutral gears and no reverse gear. It is also contemplated that a different propulsion unit 30, such as a jet drive for example, could be used.

Figure 2:
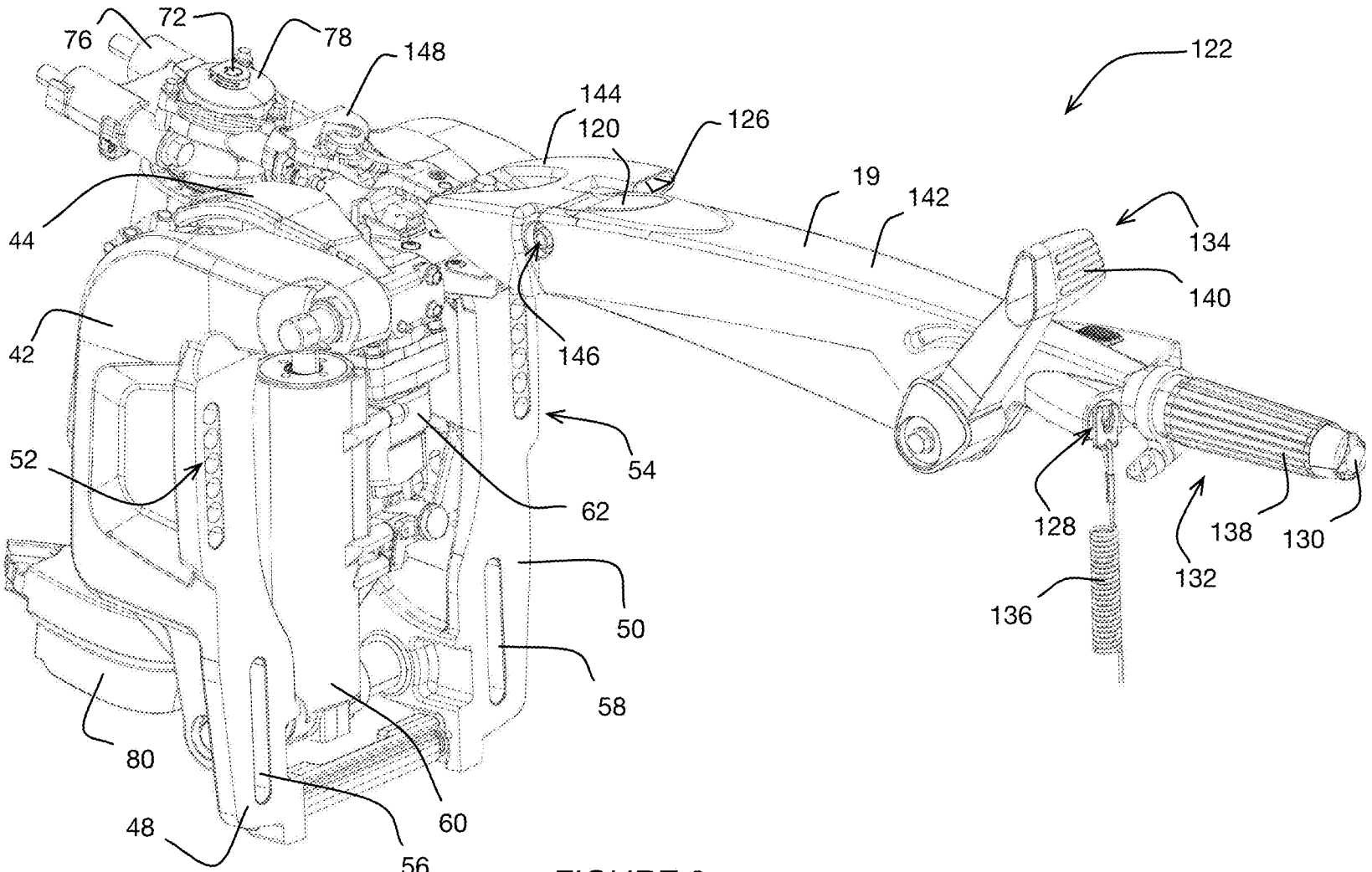
FIG. 2 is a perspective view taken from a front, right, top side of a bracket assembly and a tiller of the marine outboard motor of FIG. 1A.

The bracket assembly 12 of the marine outboard motor 10 includes a stern bracket 42 and a swivel bracket 44 pivotally connected to the stern bracket 42 about a tilt/trim axis 46. The stern bracket 42 is configured for mounting the marine outboard motor 10 to a stern or other part of a watercraft. As can be seen in FIG. 2, the stern bracket 42 includes two laterally spaced attachment members 48, 50 that contact the stern or other part of the watercraft when the marine outboard motor 10 is mounted to the stern or the other suitable part.

In the present implementation, two sets of upper mounting apertures 52, 54 and two elongate lower apertures 56, 58 are defined in the attachment members 48, 50 and are sized to receive bolts (not shown) therethrough and to allow for upward and downward adjustment of the securement position of the stern bracket 42 relative to the stern or the other suitable part. In the case of attachment to a stern of a watercraft for example, bolts are inserted through the stern and corresponding ones of the apertures 52, 54, 56, 58, and through corresponding apertures in the stern, and a nut is threaded onto each of the bolts and tightened to a suitable degree to secure the stern bracket 42, and therefore also the marine outboard motor 10, to the stern. It is contemplated that any other mounting mechanism could be used.

Still referring to FIG. 2, a hydraulic tilt/trim piston 60 is pivotably connected at one end to the stern bracket 42 and at the other end to the swivel bracket 44. The tilt/trim piston 60 is fluidly operatively connected to a hydraulic tilt/trim pump 62 mounted to the swivel bracket 44. The tilt/trim pump 62 and a tilt/trim control switch 130, which will be described in more detail herein below, are in electronic communication with the EMM 26. The tilt/trim control switch 130 is used by an operator of the marine outboard motor 10 to operate the tilt/trim pump 62 to adjust tilt/trim of the motor assembly 14.

As shown schematically in FIG. 1A, the tilt/trim pump 62 adjusts tilt/trim of the motor assembly 14 by selectively extending the tilt/trim piston 60 to pivot the swivel bracket 44 upward 64 relative to the stern bracket 42 about the tilt/trim axis 46 and retracting the tilt/trim piston 60 to pivot the swivel bracket 44 downward 66 relative to the stern bracket 42 about the tilt/trim axis 46. It is contemplated that any other suitable tilt/trim actuator could be used in addition to or instead of the tilt/trim piston 60.

Figure 3:
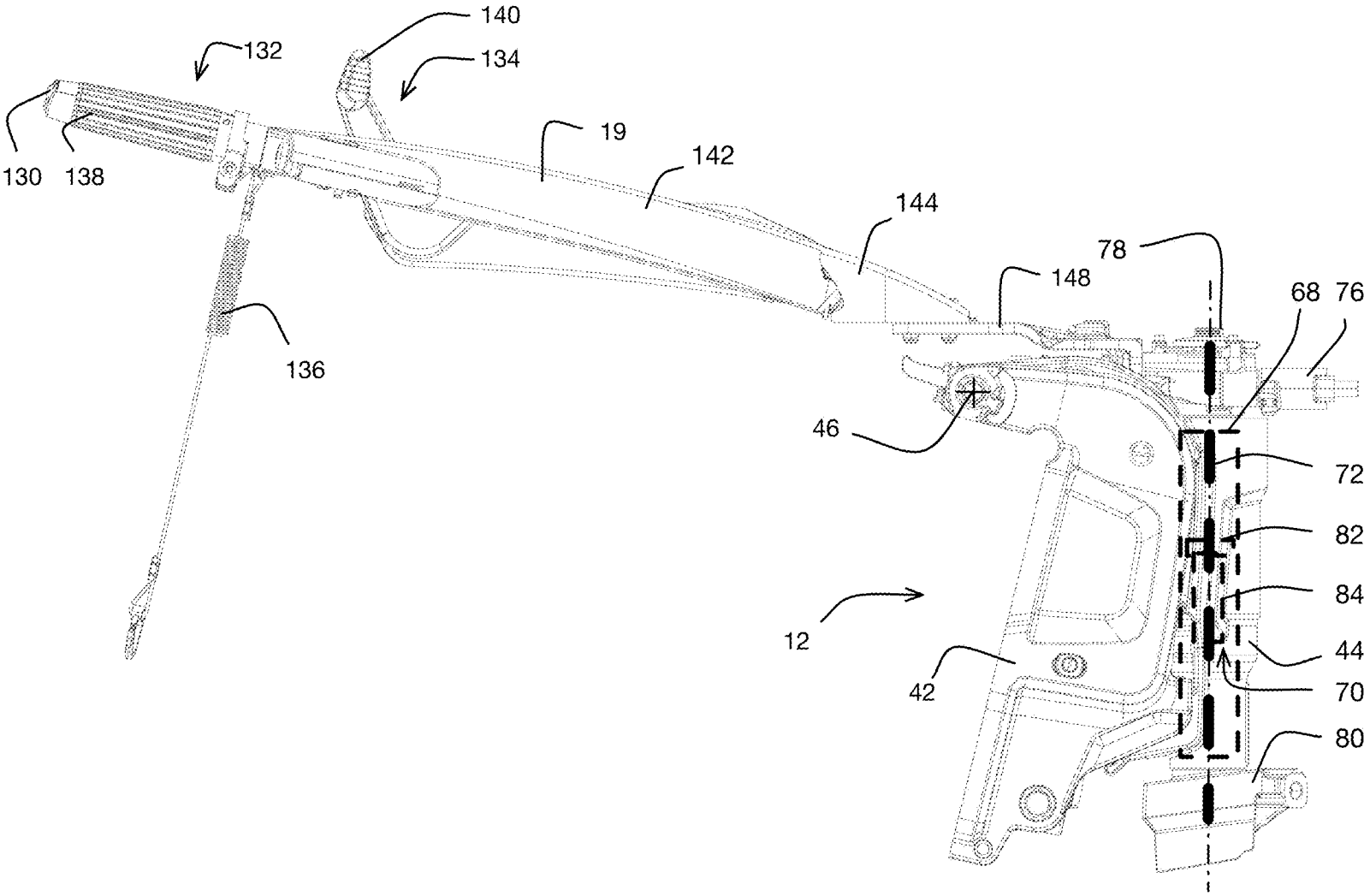
FIG. 3 is a left side elevation view of the components of the marine outboard motor of FIG. 2.

As shown schematically in FIG. 3, the swivel bracket 44 defines a cavity 68 in a rear end thereof and includes a hydraulic steering actuator 70. The hydraulic steering actuator 70 includes a pivot shaft 72, shown schematically, that extends through the cavity 68 and is pivotably supported by the swivel bracket 44 about the steering axis 16. An upper end of the pivot shaft 72 extends upward out of the cavity 68 and the swivel bracket 44. A lower end of the pivot shaft 72 extends downward out of the cavity 68 and the swivel bracket 44.

Figure 4:
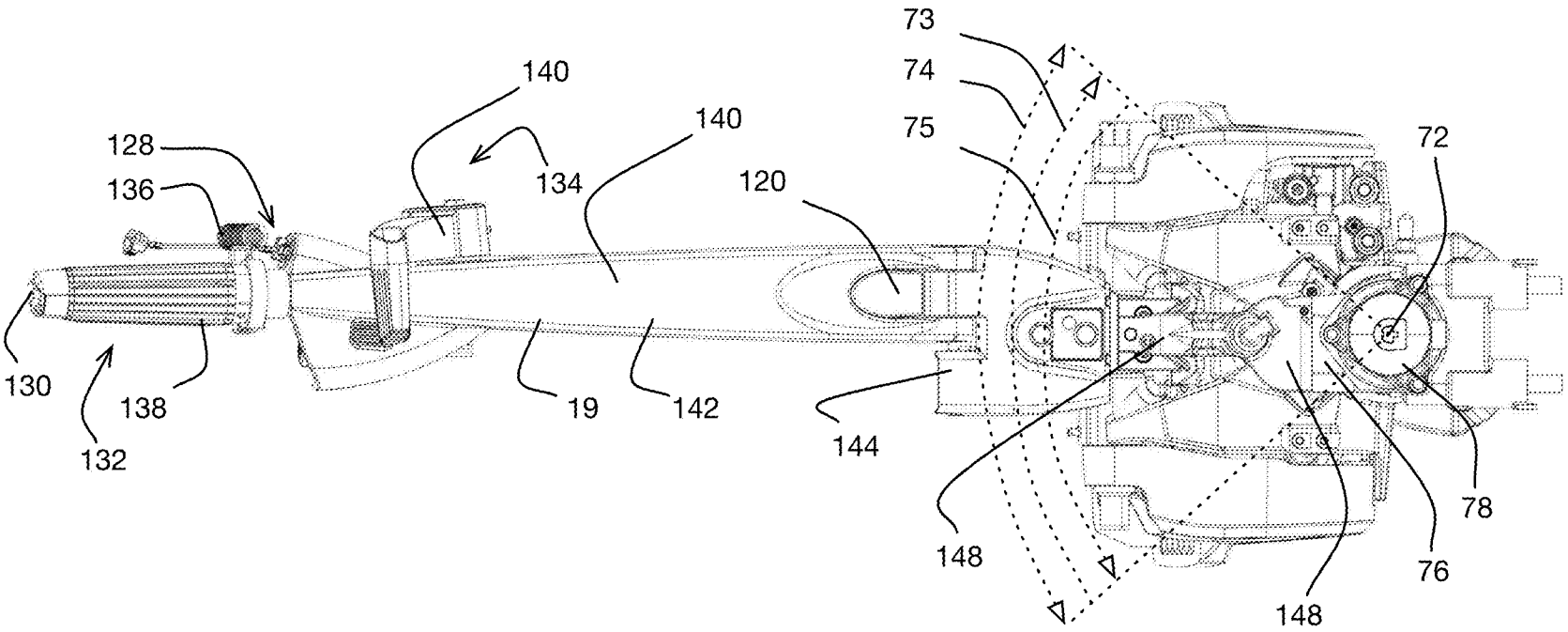
FIG. 4 is a top plan view of the components of the marine outboard motor of FIG. 2.

An upper motor mount 76 and a steering position sensor 78 are connected to the upper end of the pivot shaft 72. As shown in FIG. 4, the upper motor mount 76 extends rearward from the pivot shaft 72 and includes two male mating portions that mate with corresponding female mating portions (not shown) defined in a forward-facing portion of the motor assembly 14. A lower motor mount 80 is connected to the lower end of the pivot shaft 72 and extends downward from the bottom end of the pivot shaft 72. The lower motor mount 80 is similarly connected to the motor assembly 14.

As can be seen in FIG. 4, the pivot shaft 72 is pivotable clockwise 73 and counter-clockwise 75, when the marine outboard motor 10 is viewed from above, about the steering axis 16 within a predefined pivot range 74. The motor assembly 14 is connected to both the upper motor mount 76 and the lower motor mount 80 and pivots with the pivot shaft 72 within the pivot range 74. It is contemplated that any other mounting system and/or mounting connections could be used to connect the motor assembly 14 to the pivot shaft 72. For example, it is contemplated that a single point, or more than two mounting points, could be used. It is also contemplated that the pivot range 74 could differ depending on each particular implementation and application of the marine outboard motor 10.

As shown schematically in FIG. 3, the hydraulic steering actuator 70 further includes a hydraulically-movable piston 82 and a screw drive 84. Both the piston 82 and the screw drive 84 are disposed inside the cavity 68. The piston 82 is mounted onto the pivot shaft 72 coaxially with the pivot shaft 72 and is movable upward and downward inside the cavity 68 along the pivot shaft 72. The screw drive 84 operatively couples the piston 82 to the pivot shaft 72 and also operatively couples the pivot shaft 72 to the swivel bracket 44 inside the cavity 68 such that upward and downward movement of the piston 82 along the pivot shaft 72 pivots the pivot shaft 72, and therefore also the motor assembly 14, about the steering axis 16.

In the present implementation, movement of the piston 82 downward pivots the pivot shaft 72, and the motor assembly 14, clockwise 73 about the steering axis 16, while movement of the piston 82 upward pivots the pivot shaft 72, and the motor assembly 14, counter-clockwise 75 about the steering axis 16. It is contemplated that the screw drive 84 could be selected to reverse this steering action such that upward movement of the piston 82 would result in clockwise 73 steering, and downward movement of the piston 82 would result in counter-clockwise 75 steering. It is contemplated that a different coupling mechanism could be used to connect the piston 82 to the pivot shaft 72, instead of or in addition to the screw drive 84.

Figure 5:
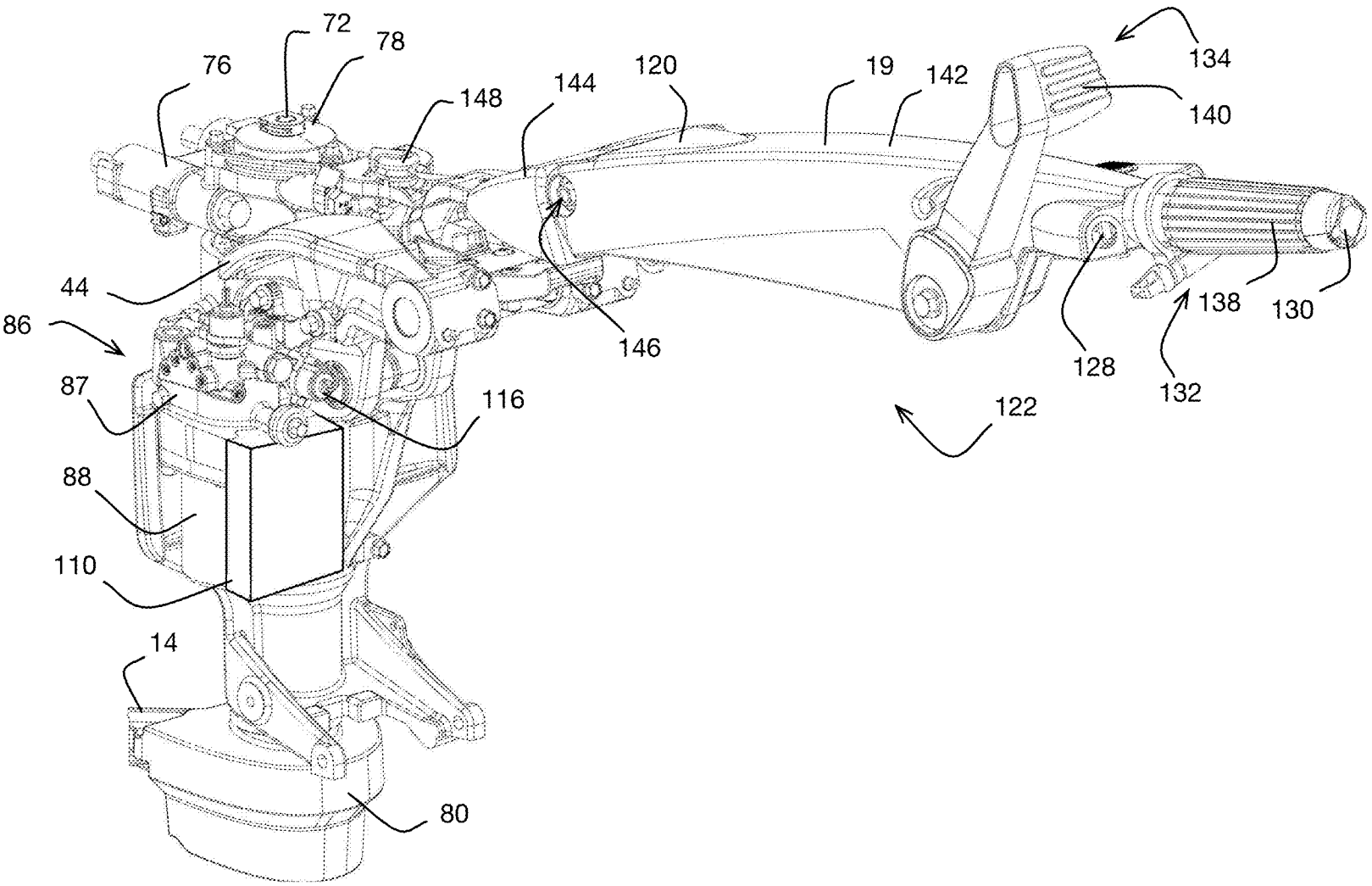
FIG. 5 is a perspective view taken from a front, right, top side of a swivel bracket, a hydraulic power steering pump and a tiller of the marine outboard motor of FIG. 1A.
Figure 6:
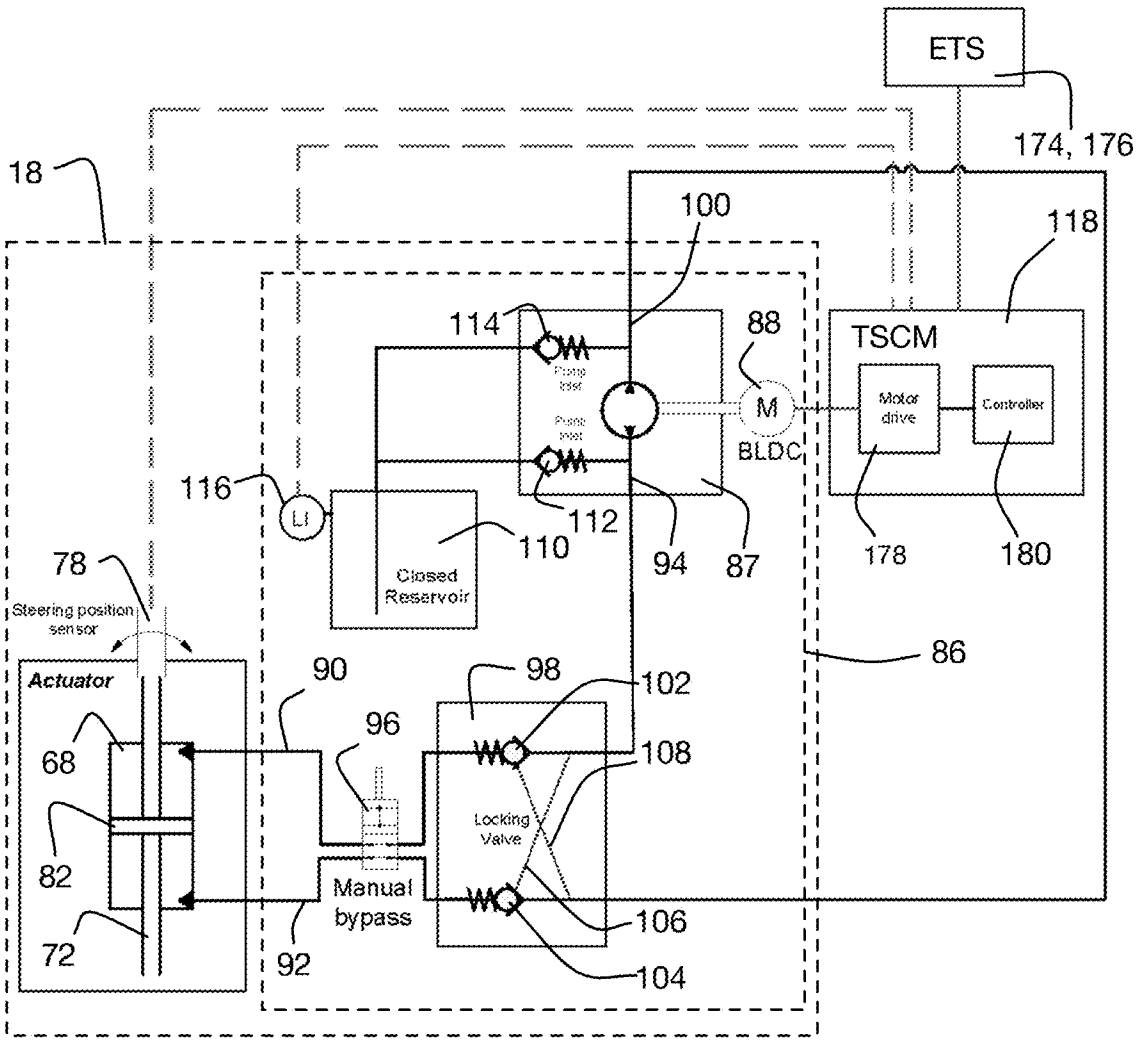
FIG. 6 is a schematic of a power steering system, an electronic torque sensor and a tiller system control module of the marine outboard motor of FIG. 1A.

Now also referring to FIGS. 5 and 6, the piston 82 is movable upward and downward along the pivot shaft 72 by a hydraulic power steering assembly 86. In the present implementation, the hydraulic power steering assembly 86 is mounted to the swivel bracket 44, but a different mounting location could be used. In this implementation, the hydraulic power steering assembly 86 includes a hydraulic power steering pump 87 that is driven by a bi-directional brushless direct current motor 88, further referred to as the power steering motor 88, that is integrated into a body of the hydraulic power steering assembly 86.

As can be seen in FIG. 6, the hydraulic power steering pump 87 is fluidly connected to the cavity 68 in the swivel bracket 44 at two locations. First, above the piston 82 via a first fluid conduit 90. Second, below the piston 82 via a second fluid conduit 92. The first fluid conduit 90 fluidly connects a top end of the cavity 68 to a first fluid port 94 of the hydraulic power steering pump 87 via a manual bypass valve 96, and a locking valve 98. The second fluid conduit 92 connects a bottom end of the cavity 68 to a second fluid port 100 of the hydraulic power steering pump 87 via the manual bypass valve 96 and the locking valve 98. In the present implementation, the manual bypass valve 96 and the locking valve 98 are integrated into the body of the hydraulic power steering assembly 86, but could be mounted elsewhere.

The manual bypass valve 96 is manually operable between a normal operation position and a bypass position. The manual bypass valve 96 is in the normal operation position in FIG. 6. In the normal operation position, the manual bypass valve 96 allows fluid flow through each of the first and second fluid conduits 90, 92 and keeps the first and second fluid conduits 90, 92 fluidly isolated from each other between the locking valve 98 and the cavity 68.

The bypass position of the manual bypass valve 96 is schematically illustrated in a top part of the manual bypass valve 96 shown in FIG. 6. When the manual bypass valve 96 is in the bypass position, the manual bypass valve 96 fluidly connects the first and second fluid conduits 90, 92 to each other inside the manual bypass valve 96 and thereby allows the piston 82 to move upward and downward along the pivot shaft 72 independent of the operation of the rest of the power steering system 18. This allows the motor assembly 14 to pivot about the steering axis 16 independent of the operation of the power steering system 18. It is contemplated that a different power steering system bypass could be used to decouple the piston 82 from the rest of the power steering system 18.

Still referring to FIG. 6, the locking valve 98 of the power steering system 18 includes a first normally-closed ball valve 102 along the first fluid conduit 90, a second normally-closed ball valve 104 along the second fluid conduit 92, a first pilot fluid conduit 106, and a second pilot fluid conduit 108. The first pilot fluid conduit 106 fluidly connects the first fluid conduit 90 to the second normally-closed ball valve 104 and opens the second normally-closed ball valve 104 while the hydraulic power steering pump 86 pumps hydraulic fluid into the first fluid conduit 90. The second pilot fluid conduit 108 fluidly connects the second fluid conduit 92 to the first normally-closed ball valve 102 and opens the first normally-closed ball valve 102 while the hydraulic power steering pump 87 pumps hydraulic fluid into the second fluid conduit 92. When the hydraulic power steering pump 87 does not operate, both the first normally-closed ball valve 102 and the second normally-closed ball valve 104 close.

When the manual bypass valve 96 is in the normal operation position, closure of both the first normally-closed ball valve 102 and the second normally-closed ball valve 104 prevents hydraulic fluid from flowing into or out of the cavity 68 either above or below the piston 82. This hydraulically locks the piston 82 in the cavity 68 and thereby prevents the pivot shaft 72 from pivoting about the steering axis 16. This, in turn, prevents steering of the marine outboard motor 10. On the other hand, when the manual bypass valve 96 is in the normal operation position and the hydraulic power steering pump 87 pumps hydraulic fluid into the cavity 68 above the piston 82, the piston 82 is pushed downward along the pivot shaft 72. This operation of the hydraulic power steering pump 87 opens the second normally-closed ball valve 104 and thereby allows the piston 82 to move downward along the pivot shaft 72. This pivots the pivot shaft 72 counter-clockwise 75 about the steering axis 16. Hydraulic fluid displaced from the lower end of the cavity 68 by the downward movement of the piston 82 flows toward the second fluid port 100 of the hydraulic power steering pump 87 via the second fluid conduit 92.

When the manual bypass valve 96 is in the normal operation position and the hydraulic power steering pump 87 pumps hydraulic fluid into the cavity 68 below the piston 82, the piston 82 is pushed upward along the pivot shaft 72. This operation of the hydraulic power steering pump 87 opens the first normally-closed ball valve 102 and thereby allows the piston 82 to move upward along the pivot shaft 72. This pivots the pivot shaft 72 counter-clockwise 75 about the steering axis 16. Hydraulic fluid displaced from the upper end of the cavity 68 by the upward movement of the piston 82 flows toward the first fluid port 94 of the hydraulic power steering pump 87 via the first fluid conduit 90.

The power steering system 18 further includes a fluidly closed hydraulic fluid reservoir 110. As shown in FIGS. 5 and 6, the fluid reservoir 110 is integrated into the body of the hydraulic power steering assembly 86. As can be seen in FIG. 6, the fluid reservoir 110 is fluidly connected to the first and second fluid conduits 90, 92 via corresponding normally-closed ball valves 112, 114 disposed in a fluid distribution manifold of the hydraulic power steering pump 87. The fluid reservoir 110 supplies hydraulic fluid into the hydraulic fluid circuit of the power steering system 18 whenever the amount of hydraulic fluid in the hydraulic fluid circuit is sufficiently low to cause at least one of the normally-closed ball valves 112, 114 to open as a result of suction created at the at least one of the normally-closed ball valves 112, 114 by the hydraulic power steering pump 87. It is contemplated that a different hydraulic fluid make-up system could be used. It is also contemplated that the fluid make-up system could be omitted.

In the present implementation, a fluid level sensor 116 is connected to the fluid reservoir 110 and senses a level of hydraulic fluid in the fluid reservoir 110. The fluid level sensor 116 is mounted to the body of the hydraulic power steering assembly 86. The fluid level sensor 116 is in communication with a tiller system control module (TSCM) 118 that controls the power steering system 18, as will be described in more detail herein below. The fluid level sensor 116 sends a fluid level signal to the TSCM 118. When fluid level in the fluid reservoir 110 is low, the TSCM 118 turns on a predetermined color of light on a diagnostic light 120 that is visible to the operator of the marine outboard motor 10. The diagnostic light 120 is described in more detail herein below.

The TSCM 118 is separate from the EMM 26 and is mounted inside the cowling 28 of the marine outboard motor 10. Like the EMM 26, the TSCM 118 is powered by the magneto 22. It is contemplated that the TSCM 118 could be mounted elsewhere and could be powered via the EMM 26. It is contemplated that the a single control module providing the functionality of the TSCM 118 and the EMM 26 could be used instead of the TSCM 118 and the EMM 26. It is also contemplated that the functionality of the TSCM 118 and the EMM 26 could be distributed among more than two control modules.

The TSCM 118 is part of a tiller system 122 of the marine outboard motor 10. The tiller system 122 is used for controlling operation of the motor 20, the transmission 34, the tilt/trim pump 62 and the power steering system 18. As can be seen in FIGS. 1A, and 2 to 6, the tiller system 122 includes the tiller 19 and the TSCM 118. The tiller 19 includes a start-stop switch 126, an engine cut-off switch 128, a tilt/trim control switch 130, a throttle control 132, a gear shift control 134, and the diagnostic light 120. The diagnostic light 120 is operable to shine in a plurality of different colors of light and different on-off light sequences that are visible to an operator of the marine outboard motor 10 in order to provide various informational messages to the operator.

As shown schematically in FIG. 1B, the start-stop switch 126 is operatively connected to the electronic starter 24 via an electronic connection to the EMM 26 for starting and shutting off the motor 20. The engine cut-off switch 128 is operatively connected to the motor 20 via an electronic connection to the EMM 26 for shutting off the motor 20. As can be seen in FIG. 2 for example, the engine cut-off switch 128 has a lanyard 136 attached thereto. The lanyard 136 is attachable to an operator of the marine outboard motor 10 and shuts off the motor 20 when removed from the engine cut-off switch 128. It is contemplated that a different start-stop and/or safety shut-off systems could be used.

The tilt/trim control switch 130 is operatively connected to the tilt/trim pump 62 via an electronic connection to the EMM 26 and operates the tilt/trim pump 62 as described herein above, by being pressed upward or downward by an operator of the marine outboard motor 10. It is contemplated that a different tilt/trim system control could be used.

The throttle control 132 is operatively connected to the motor 20, via an electronic connection to the EMM 26, for adjusting a power output of the motor 20. The gear shift control 134 is operatively connected to the transmission 34, via an electronic connection to the EMM 26, for shifting the transmission 34 between the forward, neutral, and reverse gears. The EMM 26 receives respective electronic control signals from the throttle and gear shift controls 132, 134, and controls operation of the motor and an electronic gear shift actuator 35 (FIG. 1B) of the transmission 34, respectively, in response to these signals. It is contemplated that the throttle and gear shift controls 132, 134 could be operatively connected to the motor 20 and the transmission 34, respectively, via mechanical connections in addition to, in combination with, or instead of the electronic connections of the present implementation.

The throttle control 132 includes a twist grip 138 pivotably mounted to a front end of the tiller 19. The gear shift control 134 includes a lever 140 pivotably mounted onto the tiller 19 rearward of the throttle control 132. The throttle and gear shift controls 132, 134 are mounted to a front portion 142 of the tiller 19 that pivots upward and downward relative to a rear portion 144 of the tiller 19 about a pivot connection 146. It is contemplated that any other throttle and gear shift controls could be used. It is contemplated that in implementations in which the transmission 34 has only one, forward, gear, the gear shift control 134 could be omitted. It is contemplated that the pivot connection 146 could be omitted, in which case the front and rear portions 142, 144 of the tiller 19 could be fixed relative to each other and/or could be cast integral with each other.

The tiller 19 further includes a tiller bracket 148, also referred to as a steering arm, that connects a rear end of the tiller to the upper motor mount 76 and pivots with the motor assembly 14 about the steering axis 16. It is contemplated that the tiller bracket 148 could mount the tiller 19 directly to the motor assembly 14. As shown in FIG. 1A, the tiller bracket 148 extends over the tilt/trim axis 46 when the motor assembly 14 is fully trimmed down.

Figure 7:
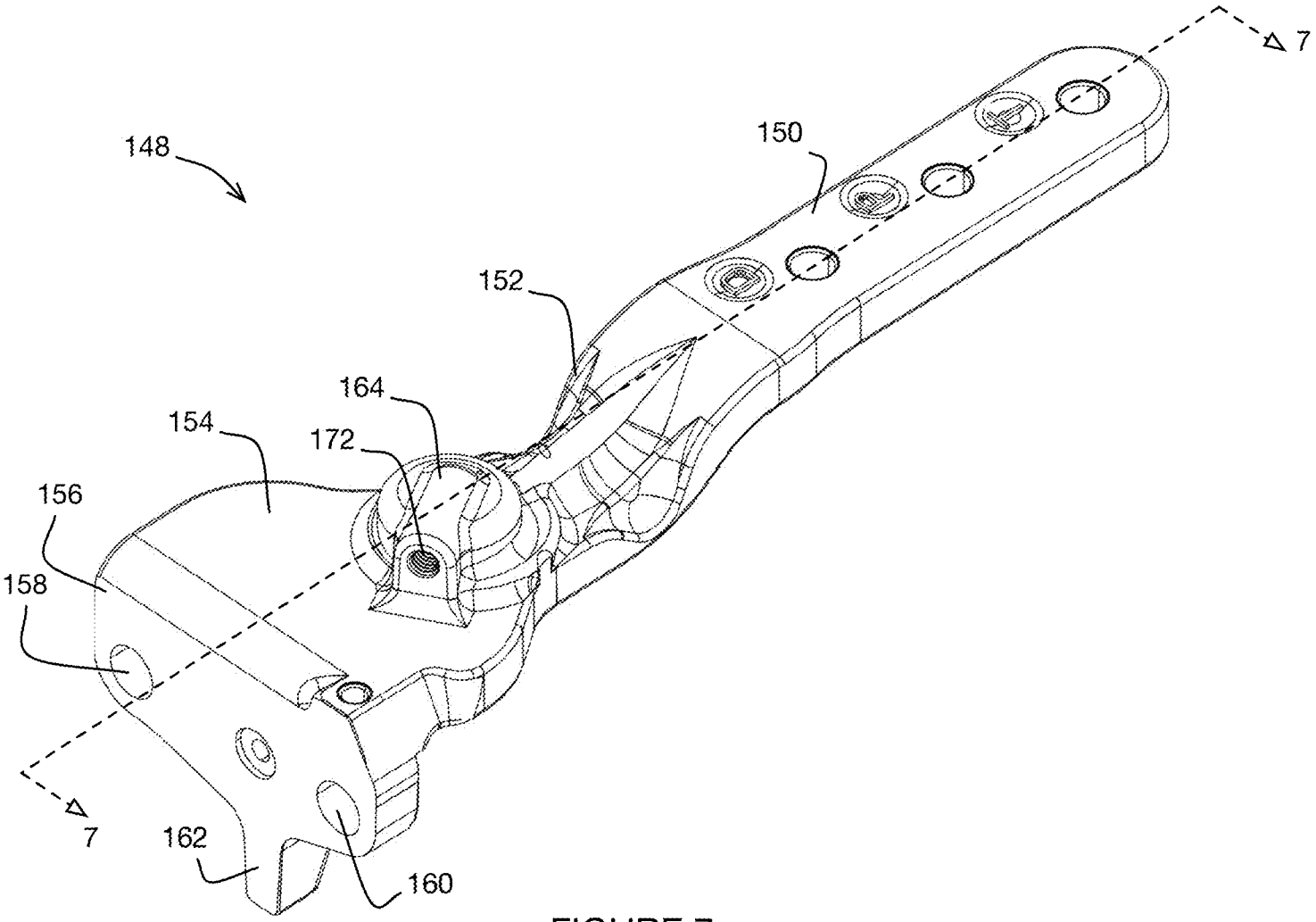
FIG. 7 is a perspective view taken from a rear, top, right side of a tiller bracket of the marine outboard motor of FIG. 1A.
Figure 8:
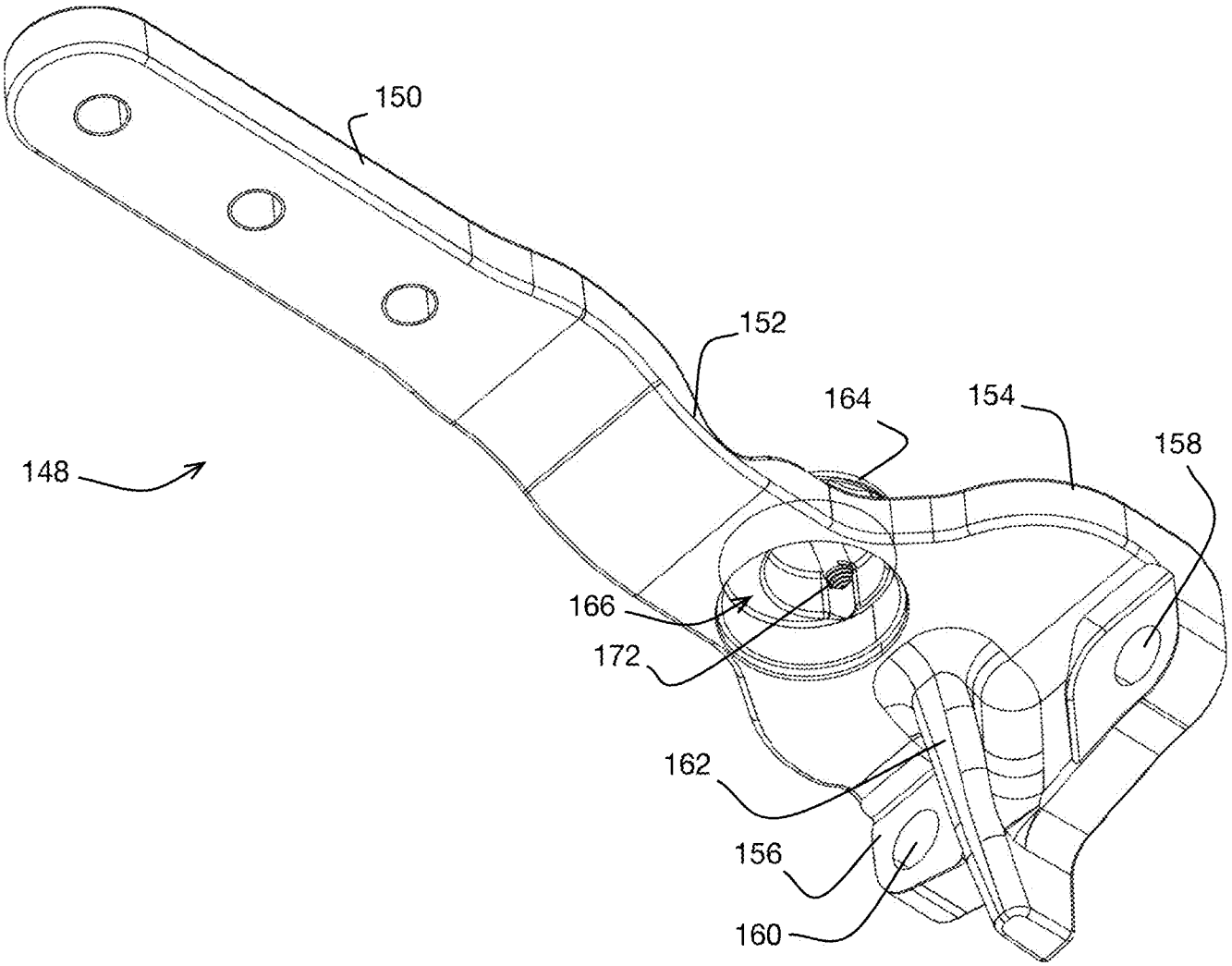
FIG. 8 is a perspective view taken from a front, bottom, left side of the tiller bracket of FIG. 7.
Figure 9:
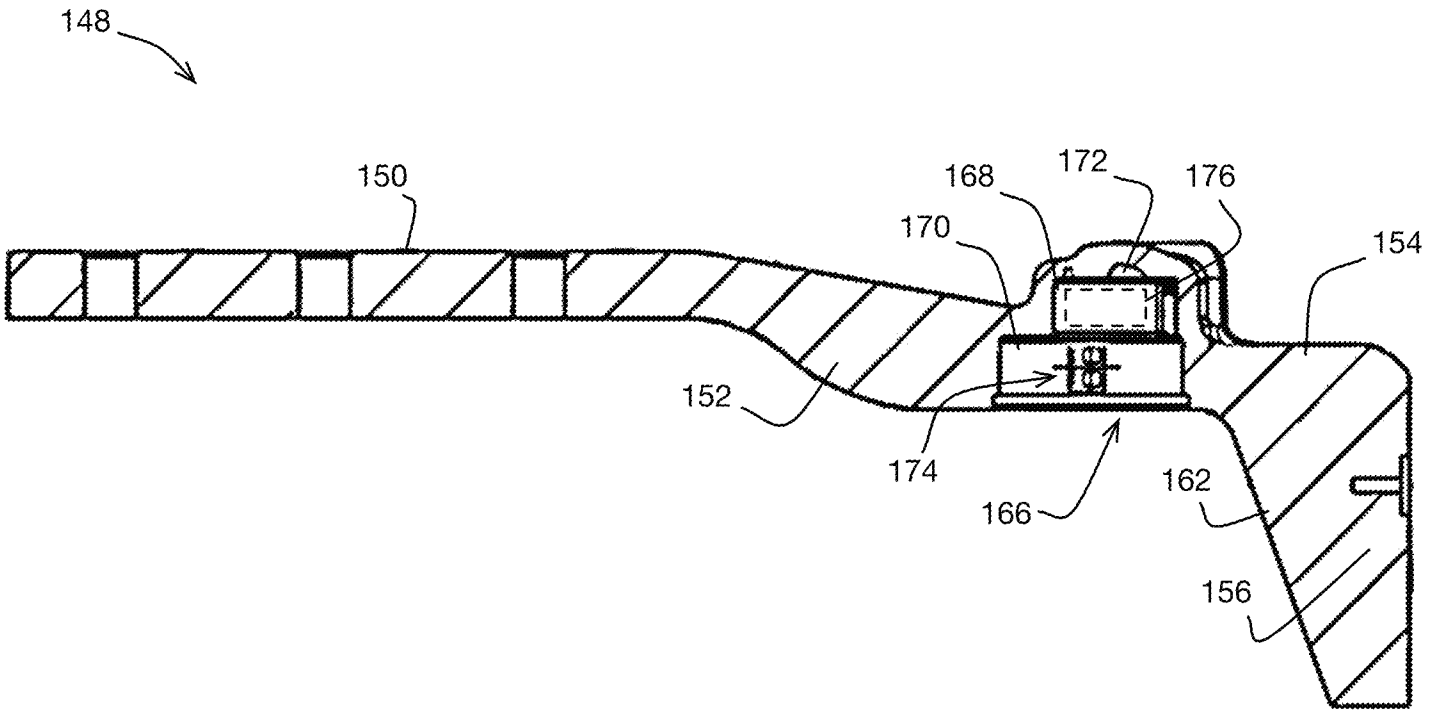
FIG. 9 is a cross-section of the tiller bracket of FIG. 7, taken along section line 7-7 of FIG. 7.

The tiller bracket 148 is shown in more detail in FIGS. 7 to 9. As shown, the tiller bracket 148 includes an elongate portion 150 that is bolted to the rear end of the tiller 19, a downwardly-arcuate portion 152 extending rearward from the elongate portion 150, and a mounting portion 154 that extends rearward from a rear end of the downwardly-arcuate portion 152.

In the present implementation, the mounting portion 154 of the tiller bracket 148 includes a downwardly-extending mounting plate 156 with two apertures 158, 160 defined therethrough. The mounting portion 154 is bolted to the upper motor mount 76 with two bolts received through corresponding ones of the two apertures 158, 160 and in corresponding threaded apertures defined in a forward facing mating surface of the upper motor mount 76, which mating surface contacts the mounting portion 154. It is contemplated that a different connection could be used. For example, the tiller bracket 148 could be cast integral with the upper motor mount 76.

The mounting portion 154 includes a longitudinally-extending rib 162 positioned laterally in the middle of the mounting plate 156. A rearward facing surface of the rib 162 abuts and is pressed against the forward facing mating surface of the upper motor mount 76 when the tiller bracket 148 is bolted to the upper motor mount 76. The rib 162 adds structural strength to the tiller bracket 148 in a vertical direction. It is contemplated that a different construction of the tiller bracket 148 could be used. For example, it is contemplated that the rib 162 could be omitted.

The mounting portion 154 defines a dome-shaped portion 164 extending upward from a top surface of the tiller bracket 148. As best seen in FIGS. 8 and 9, the portion 164 defines a dome-shaped cavity 166 therein. The dome-shaped cavity 166 is open on a bottom side of the tiller bracket 148 and includes an upper dome portion 168 and a lower dome portion 170 that is wider than the upper dome portion 168. In the illustrated implementation, the dome-shaped cavity 166 has a circular cross-section, although it is contemplated that it could be differently shaped. A channel 172 is defined through the upper dome portion 168 of the dome-shaped cavity 166 and extends into the dome-shaped cavity 166.

As can be seen in FIG. 9, an electronic torque sensor 174 is attached to the tiller bracket 148 for providing an electronic steering signal used to control an operation of the power steering system 18. More particularly, in the present implementation, the electronic torque sensor 174 is a pair of strain gauges 174, which is attached, using a suitable adhesive, to the tiller bracket 148. To this end, the strain gauges 174 are oriented relative to the tiller bracket 148 to sense torque applied to the tiller 19 about the steering axis 16 in the clockwise 73 and counter-clockwise 75 directions by outputting the electric steering signal as a function of strain of the surface of the tiller bracket 148 to which they are attached.

In the present implementation, the tiller bracket 148 is cast from a metal alloy selected to provide appropriate elastic deformation of the portion 164 of the tiller bracket 148 at the area of connection between the strain gauges 174 and the corresponding surface of the tiller bracket 148 when torque is applied to the tiller 19 about the steering axis 16, which deformation is compatible with the particular implementation of the strain gauges 174. It is contemplated that the metal alloy could be different depending on each particular implementation of the strain gauges 174 for example. It is also contemplated that any suitable material(s) and manufacturing methods could be used, so long as the functionality described in this document is provided.

As can be seen in FIG. 9, in the present implementation, the strain gauges 174 are positioned on an inner side wall of the dome-shaped cavity 166 that defines the lower dome portion 170. The strain gauges 174 are positioned and oriented relative to each other inside the dome-shaped cavity 166 to cancel out torque that could be applied to the tiller 19 about a non-vertical axis, for example as a result of vertical loads on the tiller 19 applied by an operator of the marine outboard motor 10 by leaning on the tiller 19. In other words, the relative positions and orientations of the strain gauges 174 are selected to help ensure that the power steering system 18 is not operated in response to loads applied to the tiller 19 other than those about the steering axis 16.

It is contemplated that the relative positioning and orientation of the strain gauges 174 could be selected differently than shown in FIG. 9, to suit a different implementation of the strain gauges 174 and/or the tiller bracket 148 for example.

In the present implementation, two strain gauges 174 are used for redundancy. In case of failure of one of the strain gauges 174, the tiller system 122 will operate on the remaining one of the strain gauges 174. It is contemplated that a single strain gauge could be used. It is contemplated that more than two strain gauges 174 could be used, to provide for additional redundancy for example.

The electronic steering signal provided by the strain gauges 174 represents a magnitude and a direction of torque applied to the tiller 19 about the steering axis 16. The direction is in either the clockwise 73 or the counter-clockwise 75 direction. Strain gauge electronics 176, including a voltage regulator, an amplifier and signal conditioning circuitry are in electronic communication with the strain gauges 174 and the TSCM 118 and send the electronic steering signal to the TSCM 118. In the present implementation, the electronics 176 are attached to the tiller bracket 148 and disposed and potted inside the dome-shaped cavity 166 in the upper dome portion 168. Electronic wires from the strain gauges 174 and from the electronics 176 pass out of the dome-shaped cavity 166 through the channel 172 and connect to the TSCM 118. It is contemplated that the strain gauges 174 and the electronics 176, or other electronic torque sensor(s), could be mounted elsewhere, so long as they/it are operatively connected to the tiller 19 to sense torque applied to the tiller 19 about the steering axis 16. It is also contemplated that the electronics 176 could be integrated in the TSCM 118.

As can be seen in FIG. 6, the TSCM 118 includes motor drive 178 and a motor drive controller 180 that are in electronic communication with the power steering motor 88 and operate the power steering motor 88. The motor drive 178 and the motor drive controller 180 selectively drive the power steering motor 88 in either one of two directions and thereby operate the hydraulic power steering pump 87, which pivots the pivot shaft 72 about the steering axis 16 as described herein above. To this end, the TSCM 118 controls operation of the power steering motor 88 in response to the electronic steering signal received from the strain gauges 174.

In the present implementation, the electronic steering signal is a voltage. The strain gauges 174 output a baseline voltage of 2.5 Volts (V) to the TSCM 118 as an analog signal, when no torque is applied to the tiller 19. It is contemplated that the baseline voltage could be different.

In response to receiving the baseline voltage, the TSCM 118 sends no signal to the power steering motor 88, thereby causing the power steering motor 88 to shut off if prior to receiving the baseline voltage the power steering motor 88 was operating, or to remain shut off. When the power steering motor 88 is shut-off, both of the normally-closed ball valves 102, 104 of the locking valve 98 are closed and thereby fluidly seal the part of the hydraulic fluid circuit that is fluidly between the cavity 68 in the swivel bracket 44 and each of the normally-closed ball valves 102, 104 while the manual bypass valve 96 is in its normal operation position. This hydraulically locks the piston 82 relative to the pivot shaft 72 and therefore also locks the pivot shaft 72 relative to the swivel bracket 44. This also therefore locks the motor assembly 14 and the propulsion unit 30 in its current angular steering position about the steering axis 16. It is contemplated that the locking valve 98 be omitted and that other means for locking the piston 82 relative to the pivot shaft 72, such as relying on the hydraulic power steering pump 87, could be used.

In the present implementation, when a torque is applied to the tiller 19 in a clockwise 73 direction about the steering axis 16, the voltage output from the strain gauges 174 increases above the baseline voltage. The more torque is applied to the tiller 19 in the clockwise 73 direction about the steering axis 16, the more the voltage increases. In the present implementation, the voltage can increase up to a predetermined setpoint of 4.5V.

On the other hand, when a torque is applied to the tiller 19 in a counter-clockwise 75 direction about the steering axis 16, the voltage decreases below the baseline voltage. The more torque is applied to the tiller 19 in the counter-clockwise 75 direction about the steering axis 16, the more the voltage decreases. In the present implementation, the voltage can decrease to a predetermined setpoint of 0.5V. In the present implementation, the TSCM 118 includes a processor, and a non-transitory memory module. The non-transitory memory module stores, among other information, a reference table, also known as a map, and a set of instructions that are executed by the processor to carry out the functionality of the TSCM 118 described in this document. The reference table divides the operational range of voltages, which in this implementation is 0.5V to 4.5V, into reference voltage values. It is contemplated that the spacing between the reference voltage values could be selected differently to suit each particular implementation of the power steering system 18 and the marine outboard motor 10.

The reference table assigns to each reference voltage value a power output at which the TSCM 118 is to operate the power steering motor 88, further referred to as power steering boost value, and a direction in which the TSCM 118 is to operate the power steering motor 88. Operation of the power steering motor 88 at a given power steering boost value provides a corresponding power steering boost of the power steering system 18. The TSCM 118 compares the voltage received by the TSCM 118 from the strain gauges 174 to the reference voltage values and generates a control signal in response to the voltage received from the strain gauges 174 to operate the power steering motor 88 according to the direction and the power steering boost value assigned to corresponding ones of the reference voltage values. It is contemplated that a plurality of reference tables could be stored in the non-transitory memory module and that such reference tables could be selectable by the operator, automatically selectable by control logic stored in the TSCM 118 or a combination thereof. It is contemplated that other means of generating a control signal in response to the electronic signal received from the strain gauges 174 (or another form of electronic torque sensor) could be used, such as via a formula stored in a non-transitory memory module which outputs a control signal as a function of, inter alia, the electronic control signal.

When voltage from the strain gauges 174 is equal to one of the reference voltage values, the TSCM 118 generates a control signal to operate the power steering motor 88 according to the direction and power steering value assigned to that one of the reference voltage values. When voltage from the strain gauges 174 is between two adjacent reference voltage values, the TSCM 118 uses a suitable interpolation algorithm to interpolate the power steering boost value corresponding to that voltage from the power steering boost values assigned to the two adjacent reference voltage values. The direction of operation of the power steering motor 88 is assigned to each of the reference voltage values so as to cause the pivot shaft 72, and therefore the motor assembly 14, to pivot in the same direction as the torque applied to the tiller 19 about the steering axis 16.

The power steering boost values are assigned to the reference voltage values such that the more the voltage increases above the baseline voltage, the more power steering boost the TSCM 118 gives to the power steering motor 88 to pivot the pivot shaft 72 in a corresponding direction. Similarly, the power steering boost values are assigned to the reference voltage values such that the more the voltage decreases below the baseline voltage, the more power steering boost the TSCM 118 gives to the power steering motor 88 to pivot the pivot shaft 72 in the other direction.

In other words, for example, the greater the force applied by an operator to push the tiller 19 about the steering axis 16 to steer the marine outboard motor 10 clockwise 73 about the steering axis 16, the greater the power output of the power steering motor 88, and therefore the power steering boost of the power steering system 18, is provided by the TSCM 118 to steer the marine outboard motor 10 clockwise 73 about the steering axis 16. Conversely, the greater the force applied by an operator to push the tiller 19 about the steering axis 16 to steer the marine outboard motor 10 counter-clockwise 75 about the steering axis 16, the more power output of the power steering motor 88, and therefore the power steering boost of the power steering system 18, is provided by the TSCM 118 to steer the marine outboard motor 10 counter-clockwise 75 about the steering axis 16.

In the present implementation, the reference table assigns a power steering boost value of zero, which corresponds to the power steering motor 88 being shut off, to the reference voltage value equal to the baseline voltage. When torque is no longer applied to the tiller 19, the voltage, irrespective of whether it was above or below the baseline voltage, returns to the baseline voltage and the TSCM 118. Since a zero power steering boost value is assigned to the reference voltage value that equals the baseline voltage, the TSCM 118 stops operation of the power steering motor 88. While the voltage is at the baseline voltage, the TSCM 118 does not operate the power steering motor 88.

In the present implementation, the power steering boost values are assigned to the reference voltage values symmetrically about the baseline voltage. It is contemplated that the particular relationship between the reference voltage values and the power steering boost values could be assigned based on each particular implementation and application of the marine outboard motor 10. It is contemplated that a different function(s) and/or algorithm(s) could be used to determine an appropriate combination of power steering boost values and/or direction of operation of the power steering motor 88 in response to the voltage received by the TSCM 118 from the strain gauges 174. For example, it is contemplated that the TSCM 118 could use Proportional-Integral and/or a Proportional-Integral-Derivative controls to generate a control signal to control the power steering motor 88 in response to the voltage received from the strain gauges 174.

In the present implementation, the TSCM 118 stops and does not operate the power steering motor 88 by not sending a control signal to the power steering motor 88. For the purposes of this application, not sending a control signal to the power steering motor 88 is considered to be a control signal, further referred to as a shut-off signal. It is contemplated that the TSCM 118 could be configured to generate and send a different shut-off signal, such as a non-zero control signal, to the power steering motor 88 to shut off and not operate the power steering motor 88, depending on the particular implementation of the power steering motor 88 and its controls for example. It is also contemplated that a predefined range of voltages that would include the baseline voltage, and which could be symmetrical about the baseline voltage, could be provided in which the power steering motor 88 would be shut off. In some implementations, this predefined range could be adjustable.

In some implementations, this predefined range could be used to adjust sensitivity of the power steering system 18, so that, for example, the power steering system 18 would not respond to a torque being applied to the tiller 19 about the steering axis 16 until the torque exceeds a predetermined magnitude in either direction about the steering axis 16. It is contemplated that other means for adjusting sensitivity of the power steering system 18 could be provided, such as the plurality of reference tables mentioned above. In some implementations, this predefined range could be used to account for fluctuations in the electronic steering signal that may occur from sources other than torque being applied to the tiller 19.

In the present implementation, the TSCM 118 also stops and/or does not operate the power steering motor 88 when the pivot shaft 72 reaches either one of the two ends of its pivot range 74. To this end, and as seen in FIG. 6, the TSCM 118 is in electronic communication with the steering position sensor 78 and receives a steering position signal from the steering position sensor 78. The steering position signal is representative of the angular position of the pivot shaft 72 about the steering axis 16. The TSCM 118 stops the power steering motor 88 when the steering position signal indicates that the pivot shaft 72 has reached either one of the two ends of its pivot range 74 (shown in FIG. 4).

In another aspect, a buffer, also known as a diagnostic band, of 0.5V is provided at each end of the 0.5V to 4.5V working range of the electronic steering signal and the TSCM 118 is configured to register a fault and stop operation of the power steering motor 88 when the electronic steering signal is at less than 0.5V or more than 4.5V. It is contemplated that a different working range and/or diagnostic band(s) and/or fault and/or safety shut-off set points could be used. For example, it is contemplated that negative voltages could be used. It is contemplated that increases in the voltage could be used to provide counter-clockwise 75 steering, and decreases in the voltage could be used to provide clockwise 73 steering. It is also contemplated that the voltage could be converted into and received by the TSCM 118 as a digital signal. Such a conversion could be done by a suitable analog-to-digital signal converter for example. It is also contemplated that where the TSCM 118 receives a digital signal, the TSCM 118 could include a digital-to-analog signal converter for decoding the digital signal.

In an aspect, the variable power steering boost provided by the tiller system 122 as a function of torque applied to the tiller 19 allows an operator to pivot the motor assembly 14 and the propulsion unit 30 about the steering axis 16 slower or faster, depending on how hard the operator pushes on the tiller (i.e. depending on how much torque the operator applies to the tiller about the steering axis 16). To a similar end, in the present implementation, the TSCM 118 is operable in two different operating modes selectable by the operator.

A first of the two different operating modes corresponds to a low-boost mode. In the low-boost mode, the TSCM 118 provides relatively lower power outputs to the power steering motor 88 for each given magnitude of an increase or decrease of the voltage. A second of the plurality of different operating modes corresponds to a high-boost mode. In the high-boost mode, the TSCM 118 provides relatively higher power outputs to the power steering motor 88 for each given magnitude of an increase or decrease of the voltage. As such, the power at which the TSCM 118 operates the power steering motor 88 when the voltage is at 0.5V is lower in the low-boost mode than in the in the high-boost mode. Similarly, the power at which the TSCM 118 operates the power steering motor 88 when the voltage is at 4.5V is lower in the low-boost mode than in the in the high-boost mode. It is contemplated that the TSCM 118 could have a single operating mode, or more than the two different operating modes.

As described herein above, each of the two strain gauges 174 is an example of an electronic torque sensor that could be used to sense torque applied by an operator to the tiller 19 about the steering axis 16 for steering the marine outboard motor 10. It is contemplated that one or more different electronic torque sensors could be used instead of or in combination with the strain gauges 174. It is contemplated that the tiller bracket 148 could have a different geometry and features to provide for proper operation of the particular different type of electronic torque sensor. For example, it is contemplated that in some such implementations, the dome-shaped portion 164 of the tiller bracket 148 could be omitted. It is contemplated that one or more of force sensitive resistors and/or proximity sensors could be operatively connected to the tiller 19 to sense a magnitude and direction of torque applied by an operator to the tiller 19 about the steering axis 16. It is contemplated that electronic torque sensor(s) could output a digital electronic steering signal, or a combination of a digital and analog signals, to the TSCM 118.

It is contemplated that the marine outboard motor 10 could have a different power steering system, such as a purely electronic power steering system, or a hydraulic power steering system that uses a unidirectional power steering motor 88 in combination with a suitable hydraulic fluid reversing valve for example. It is contemplated that in some such implementations, the hydraulic fluid reversing valve could be operated by the TSCM 118, instead of selectively operating the power steering motor 88 in the two different directions, to provide the functionality provided in the present implementation by selectively operating the power steering motor 88 in the two different directions as described in this document. It is contemplated that the tiller system 122 could be used to control such other power steering systems. It is contemplated that the tiller system 122 could be implemented with a different marine outboard motor.

It is contemplated that the tiller bracket 148 could mount the tiller 19 to the stern bracket 42 instead of the upper motor mount 76, such that the tiller 19 would not pivot about the steering axis 16 with the motor assembly 14. In this case, to steer the marine outboard motor 10, torque could be applied by an operator to the tiller 19 about a point between the mounting portion 154 and the stern bracket 42, and would be sensed by the strain gauges 174 and in the same way as described herein above. Accordingly, the power steering system 18 would be controlled in the same way as described herein above.

Similarly, it is contemplated that the tiller bracket 148 could mount the tiller 19 to the swivel bracket 44 instead of the upper motor mount 76, such that the tiller 19 would not pivot about the steering axis 16 with the motor assembly 14 but would pivot with the swivel bracket 44 about the tilt/trim axis 46. In this case, to steer the marine outboard motor 10, torque could be applied to the tiller 19 about a point between the mounting portion 154 and the swivel bracket 44 and would be sensed by the strain gauges 174 in the same way as described herein above. Accordingly, the power steering system 18 would be controlled in the same way as described herein above.

It is contemplated that the TSCM 118 would be configured to provide the functionality described in this document depending on each particular implementation of the tiller system 122 and the marine outboard motor 10. For example, it is contemplated that the TSCM 118 would be configured to provide the functionality described in this document depending on each particular combination of electronic torque sensor(s) and/or electronic steering signal(s) and/or power steering system(s). It is also contemplated that the TSCM 118 could be configured to receive, for example, a motor speed signal representative of an operating speed of the motor 20, and to generate a control signal to control the power steering motor 88 as a function of both the electronic steering signal and the motor speed signal to steer the motor assembly 14 about the steering axis 16.

The illustrated embodiments described here include a tiller 19 that is mechanically coupled, more precisely bolted, to the upper motor mount 76. However, it is contemplated that tiller 19 could be mechanically decoupled from the bracket assembly 12. In one such alternative embodiment, the tiller bracket 148, and hence the tiller 19 as a whole, is not bolted to the upper motor mount 76 or elsewhere on the bracket assembly 12 or the motor assembly 14. Rather, the tiller bracket 148 is fixed elsewhere in the watercraft within reach of an operator. Apart from where the tiller bracket 148 is fixed, it and the bracket assembly 12 would remain the same as described above, including the hydraulic power steering assembly 86, the TSCM 118 and the remainder of the power steering system 18. The electric torque sensor 174 and associated electronics 176 remain in electronic communication with the TSCM 118 as illustrated in FIG. 6. In operation, the electric torque sensor 174 and electronics 176 emits an electronic steering signal in response to a torque applied to the tiller 19 by the operator. The electronic steering signal is received by the power steering system 18, wherein a reference table stored in the TSCM 118 stores a corresponding power steering value for each electronic steering signal. The power steering value generated by the TSCM 118 is used to control the power steering steering pump 87 and hence the position and movement of the motor assembly 14 about the steering axis 16.

In another aspect, the present technology also provides a method for steering the marine outboard motor 10. The method includes sensing a torque applied to a tiller 19 of the marine outboard motor 10 with one or more electronic torque sensor, for example with the strain gauges 174, generating an electronic steering signal as a function of the torque sensed by the one or more electronic torque sensor, generating a control signal as a function of the electronic steering signal, communicating the control signal to the power steering system 18 of the marine outboard motor 10, by for example communicating the control signal to the steering actuator 70 of the power steering system 18, and actuating the power steering system 18 of the marine outboard motor 10 in response to the control signal being received.

In some implementations, sensing of the torque includes sensing a magnitude and a direction of the torque, generating of the electronic steering signal includes generating the electronic control signal as a function of the magnitude and the direction of the torque, and actuating of the power steering system 18 includes actuating the power steering system 18 in response to the magnitude and the direction of the torque.

In some implementations, generating of the electronic steering signal includes generating a voltage representative of the magnitude and the direction of the torque.

It will be appreciated that the various implementations of the method may be carried out by, for example, using the technology described herein above, or as another example using a suitable combination of conventionally known technology configured using conventionally known engineering principles to carry out the steps of the method.

Modifications and improvements to the above-described implementations of the present technology may become apparent to those skilled in the art. The foregoing description is intended to be exemplary rather than limiting.

The invention claimed is:

1. A tiller system for a marine outboard motor, the marine outboard motor having a bracket assembly for mounting the marine outboard motor to a watercraft, a motor assembly pivotably mounted to the bracket assembly about a steering axis, and a power steering system for pivoting the motor assembly about the steering axis, the tiller system comprising:

a tiller adapted for steering at least one of the bracket assembly and the motor assembly;

a throttle control mounted to the tiller;

an electronic torque sensor operatively connected to the tiller to output an electronic steering signal as a function of torque applied to the tiller for steering the motor assembly about the steering axis when the tiller system is in use; and a tiller system control module (TSCM) in electronic communication with the electronic torque sensor to receive the electronic steering signal, the TSCM being adapted for controlling an operation of the power steering system in response to the electronic steering signal.

2. The tiller system of claim 1, wherein the tiller includes a tiller bracket adapted for connecting the tiller to the bracket assembly of the marine outboard motor, and the electronic torque sensor is mounted to the tiller bracket.

3. The tiller system of claim 1, wherein the electronic torque sensor includes at least one of a strain gauge, a force sensitive resistor, and a proximity sensor.

4. The tiller system of claim 1, wherein the electronic steering signal is a voltage.

5. The tiller system of claim 4, wherein the voltage is at a baseline voltage when no torque is applied to the tiller.

6. The tiller system of claim 5, wherein:

a) the voltage increases from the baseline voltage by:

i) a first value when a first magnitude of torque is applied to the tiller in a first direction, and ii) a second value when a second magnitude of torque is applied to the tiller in the first direction, the second value being larger than the first value, and the second magnitude being larger than the first magnitude; and b) the voltage decreases from the baseline voltage by:

i) a third value when the first magnitude of torque is applied to the tiller in a second direction that is opposite the first direction, and ii) a fourth value when the second magnitude of torque is applied to the tiller in the second direction, the fourth value being larger than the third value.

7. The tiller system of claim 6, wherein when the tiller system is in use:

a) the TSCM is configured to control the power steering system to steer the motor assembly about the steering axis in the first direction when the voltage is above the baseline voltage; and b) the TSCM is configured to control the power steering system to steer the motor assembly about the steering axis in the second direction when the voltage is below the baseline voltage.

8. The tiller system of any one of claim 1, wherein the electronic steering signal is representative of a magnitude and a direction of the torque applied to the tiller.

9. The tiller system of claim 1, wherein the electronic steering signal is an analog signal that is representative of a magnitude and a direction of the torque applied to the tiller.

10. The tiller system of claim 9, wherein when the tiller system is in use:

a) the TSCM is configured to control the power steering system to steer the motor assembly about the steering axis in a clockwise direction when the analog signal represents a torque applied to the tiller in a clockwise direction about the steering axis; and b) the TSCM is configured to control the power steering system to steer the motor assembly about the steering axis in a counter-clockwise direction when the analog signal represents a torque applied to the tiller in a counter-clockwise direction about the steering axis.

11. The tiller system of claim 10, wherein when the tiller system is in use:

a) the TSCM is configured to increase a power steering boost of the power steering system in the clockwise direction when the analog signal represents an increase of a magnitude of the torque applied to the tiller in the clockwise direction about the steering axis; and b) the TSCM is configured to increase the power steering boost of the power steering system in the counter-clockwise direction when the analog signal represents an increase of a magnitude of the torque applied to the tiller in the counter-clockwise direction about the steering axis.

12. The tiller system of claim 1, wherein when a magnitude of the torque applied to the tiller is within a predefined range of magnitudes, the TSCM is configured for not causing the power steering system to steer the motor assembly.

13. The tiller system of claim 1, wherein the TSCM is configured to:

a) receive a motor speed signal representative of an operating speed of the motor assembly, and b) generate a control signal as a function of the electronic steering signal and the motor speed signal for controlling the operation of the power steering system to steer the motor assembly about the steering axis.

14. The tiller system of claim 1, wherein the TSCM is operable in a plurality of different operating modes selectable by the operator, a first of the plurality of different operating modes corresponding to a low-boost mode of controlling the power steering system, and a second of the plurality of different operating modes corresponding to a high-boost mode of controlling the power steering system.

15. A marine outboard motor, comprising:

a bracket assembly for mounting the marine outboard motor to a watercraft;

a motor assembly pivotably mounted to the bracket assembly about a steering axis;

a power steering system for pivoting the motor assembly about the steering axis;

a tiller for steering at least one of the bracket assembly and the motor assembly;

a throttle control mounted to the tiller, the throttle control being operatively connected to the motor assembly for controlling the motor assembly;

an electronic torque sensor operatively connected to the tiller to output an electronic steering signal as a function of torque applied to the tiller for steering the motor assembly about the steering axis when the marine outboard motor is in use; and a tiller system control module (TSCM) in electronic communication with the electronic torque sensor to receive the electronic steering signal, the TSCM controlling an operation of the power steering system to steer the motor assembly about the steering axis in response to the electronic steering signal.

16. The marine outboard motor of claim 15, wherein:

a) the tiller includes a tiller bracket connecting the tiller to the bracket assembly and the electronic torque sensor is mounted to the tiller bracket;

b) the bracket assembly is operable to pivot the motor assembly about a trim axis; and c) the tiller bracket extends over the trim axis when the motor assembly is fully trimmed down.

17. The marine outboard motor of claim 15, wherein:

a) the power steering system includes a hydraulic pump operable to steer the motor assembly about the steering axis; and b) the TSCM controls an operation of the hydraulic pump to steer the motor assembly about the steering axis in response to the electronic steering signal.

18. A method for steering a marine outboard motor having a power steering system, the method comprising:

sensing a torque applied to a tiller of the marine outboard motor with an electronic torque sensor;

generating an electronic steering signal as a function of the sensed torque;

generating a control signal as a function of the electronic steering signal;

communicating the control signal to the power steering system of the marine outboard motor; and actuating the power steering system in response to the control signal being received.

19. The method of claim 18, wherein:

sensing of the torque includes sensing a magnitude and a direction of the torque;

generating of the electronic steering signal includes generating the electronic control signal as a function of the magnitude and the direction of the torque; and actuating of the power steering system includes actuating the power steering system in response to the magnitude and the direction of the torque.

* * * * *